US011293185B1

(12) United States Patent
Sullivan

(10) Patent No.: US 11,293,185 B1
(45) Date of Patent: Apr. 5, 2022

(54) ATTIC STAIR ASSEMBLIES AND METHODS OF INSTALLING ATTIC STAIR ASSEMBLIES

(71) Applicant: James Dee Sullivan, Manvel, TX (US)

(72) Inventor: James Dee Sullivan, Manvel, TX (US)

( * ) Notice: Subject to any disclaimer, the term of this patent is extended or adjusted under 35 U.S.C. 154(b) by 0 days.

(21) Appl. No.: 17/118,937

(22) Filed: Dec. 11, 2020

(51) Int. Cl.
*E04F 11/06* (2006.01)
*E04B 9/00* (2006.01)

(52) U.S. Cl.
CPC ..... *E04F 11/062* (2013.01); *E04B 9/003* (2013.01)

(58) Field of Classification Search
CPC .... E04H 4/14; E04B 9/003; E04F 2011/1819; E04F 11/1812; E04F 11/1817; E04F 11/1834; E04F 11/1838; E04F 11/1865; E04F 11/062; E04F 11/04; E04F 11/06; E04F 11/064; E04F 11/066; E04F 11/068
See application file for complete search history.

(56) References Cited

U.S. PATENT DOCUMENTS 2,765,970 A * 10/1956 Manierre ..... E04F 11/04 182/80
4,418,792 A * 12/1983 Cerone ..... A61G 7/1005 182/106
5,282,339 A * 2/1994 Devlin ..... E02D 29/12 182/106
5,417,016 A * 5/1995 Dahowski ..... E04H 4/08 4/496
6,347,686 B1 * 2/2002 Hedley ..... B60R 3/02 182/127
6,477,972 B2 * 11/2002 Perkins ..... E02D 29/12 114/201 R
6,830,127 B2 * 12/2004 Johnson ..... E02D 29/12 182/113
7,587,866 B1 * 9/2009 Perkins ..... E04F 11/064 182/78
8,702,069 B1 * 4/2014 Byers ..... E04F 11/1812 256/65.14
8,997,411 B2 * 4/2015 Whitten ..... E04F 11/064 52/183
9,540,824 B1 * 1/2017 Sandburg ..... E04F 11/064
(Continued)

FOREIGN PATENT DOCUMENTS

DE 19717207 C1 12/1998
FR 2341716 A1 9/1977
(Continued)

*Primary Examiner* — Jessica L Laux
(74) *Attorney, Agent, or Firm* — Elliot Law PLLC; Douglas H. Elliott; Nathan Q. Huynh

(57) ABSTRACT

Disclosed herein are attic stair assemblies, in which each attic stair assembly may include: a frame that may include: a first wall; and a second wall; a stair coupled to the frame closer to the first wall than the second wall; a floorboard disposed above the stair; a port extending through the frame and the floorboard; and a support frame removably coupled to the floorboard that may include: a first leg having a first leg upper end, wherein the first leg may be closer to the first wall than the second wall; and a second leg having a second leg upper end, wherein the second leg may be shorter than the first leg and may be closer to the first wall than the second wall; and a rail portion extending from the first leg upper end to the second leg upper end at a first acute angle to the floorboard.

19 Claims, 10 Drawing Sheets

(56) References Cited

U.S. PATENT DOCUMENTS

| | | | | |
|---|---|---|---|---|
| 9,695,630 | B1 * | 7/2017 | Arthur | E06B 5/01 |
| 10,100,576 | B1 * | 10/2018 | Dimovski | E04F 11/062 |
| 2006/0278472 | A1 * | 12/2006 | Kenton | E04H 17/1417 182/113 |
| 2008/0256864 | A1 | 10/2008 | Stoffels | |
| 2010/0155176 | A1 * | 6/2010 | Lohr | E06C 7/16 182/113 |
| 2015/0047273 | A1 * | 2/2015 | Whitten | E04F 11/064 52/183 |

FOREIGN PATENT DOCUMENTS

| | | | |
|---|---|---|---|
| KR | 200319343 | Y1 | 7/2003 |
| WO | WO2019182452 | A1 | 9/2019 |

* cited by examiner

ATTIC STAIR ASSEMBLIES AND METHODS OF INSTALLING ATTIC STAIR ASSEMBLIES

BACKGROUND

1. Field of Inventions

The field of this application and any resulting patent is attic stair assemblies and methods of installing attic stair assemblies.

2. Description of Related Art

Various attic stair assemblies and methods of installing attic stair assemblies have been proposed and utilized. However, those methods and structures lack the combination of steps and/or features of the methods and/or structures disclosed herein. Furthermore, it is contemplated that the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

Disclosed herein are attic stair assemblies, in which each attic stair assembly may include: a frame that may include: a first wall; and a second wall; a stair coupled to the frame closer to the first wall than the second wall; a floorboard disposed above the stair; a port extending through the frame and the floorboard; and a support frame removably coupled to the floorboard that may include: a first leg having a first leg upper end, wherein the first leg may be closer to the first wall than the second wall; and a second leg having a second leg upper end, wherein the second leg may be shorter than the first leg and may be closer to the first wall than the second wall; and a rail portion extending from the first leg upper end to the second leg upper end at a first acute angle to the floorboard.

Additionally, disclosed herein are attic stair assemblies, in which each attic stair assembly may include: a floorboard having an upper surface that faces the inside of the attic, a stair that extends at an angle from a lower floor surface below the attic to the attic; a port extending through the floorboard, providing for entry to the attic via the stair and exit from the attic via the stair; and a support frame that may include: a forward portion coupled to the floorboard at a first position, a rear portion coupled to the floorboard at a second position, and an intermediate portion disposed between the forward and rear portions, the intermediate portion having either (a) a curved shape with a concave lower side and a convex upper side; or (b) a linear shape with a central axis disposed at an acute angle relative to the portion of the upper surface of the floorboard closest to the intermediate portion.

Also, disclosed herein are attic stair assemblies, in which each attic stair assembly may include: a frame that may have: a first wall; a second wall facing the first wall; a stair coupled to the frame, the stair extending at a first acute angle to the floorboard away from the first wall and towards the second wall; a floorboard disposed above the stair; a port extending through the frame and the floorboard; and a support frame removable coupled to the floorboard, wherein the support frame may have a curved portion having a tangent line extending at a second acute angle to the floorboard away from the first wall and away from the second wall.

In addition, disclosed herein are attic stair assemblies, in which each attic stair assembly may include: a frame that may have: a first wall having a first plane; and a second wall having a second plane; a stair coupled to the frame; a floorboard disposed above the stair; a port extending through the frame and the floorboard; and a support frame removably coupled to the floorboard that may include: a first leg having a first upper end; and a second having a second upper end, wherein the second leg may be shorter than the first leg and may be disposed between the first plane and the second plane; and a rail portion extending from the first upper end and the first wall towards the second upper end and the second wall.

Furthermore, disclosed herein are attic stair assemblies, in which each attic stair assembly may include: a frame that may include: a first frame side-edge; a second frame side-edge; a front frame edge extending from the first frame side-edge to the second frame side-edge; and a rear frame edge extending from the first frame side-edge to the second frame side-edge; a stair coupled to the front frame edge, wherein the stair may be capable of being pivoted to form a stair angle with the first frame side-edge or the second frame side-edge; a floorboard disposed above a lower edge of the frame; a first bracket coupled to the floorboard; a second bracket coupled to the floorboard; and a support frame that include: a first leg having an upper first leg portion and a lower first leg portion, wherein the lower first leg portion may be removably coupled to the first bracket; a second leg shorter than the first leg and having an upper second leg portion and a lower second leg portion, wherein the lower second leg portion may be removably coupled to the second bracket, wherein the front frame edge may be disposed between the first leg and the second leg; and a rail extending from the first leg to the second leg, wherein the rail may be disposed at a rail angle, relative to first frame side-edge or the second frame side-edge.

Disclosed herein are attic stair assemblies, in which each attic stair assembly may include: a frame that may have: a first wall; and a second wall facing the first wall; a stair coupled to the frame; a floorboard disposed above the stair; a port extending through the frame and the floorboard; and a support frame removable coupled to the floorboard, wherein the support frame may have a rail portion extending at a first acute angle to the floorboard away from the first wall and away from the second wall at a second acute angle.

Disclosed herein are methods of installing attic stair assemblies, in which each method may include: disposing a frame in an attic floor to define a port therethrough, where, the frame may have: a first wall; and a second wall facing the first wall; coupling a stair to the frame; disposing a floorboard above the stair; and coupling a support frame to the floorboard, wherein the support frame may have a rail portion extending at a first acute angle to the floorboard away from the first wall and away from the second wall at a second acute angle.

Disclosed herein are methods of installing attic stair assemblies, in which each method may include: disposing a floorboard inside the attic, where the floorboard may have an upper surface facing the inside of the attic, coupling a stair to the attic, wherein the stair may extend at an angle from a lower floor surface below the attic; disposing a port through the floorboard, providing for entry to the attic via the stair and exit from the attic via the stair; and disposing a support frame in the attic.

Disclosed herein are methods of installing attic stair assemblies, in which each method may include: disposing a frame in an attic floor to define a port therethrough, where, the frame may have: a first frame side-edge; a second frame side-edge; a front frame edge extending from the first frame side-edge to the second frame side-edge; and a rear frame edge extending from the first frame side-edge to the second frame side-edge; coupling a stair to the front frame edge, wherein the stair may be capable of being pivoted to form a stair angle with the first frame side-edge or the second frame side-edge; disposing a floorboard above a lower edge of the frame; coupling a first bracket to the floorboard; coupling a support frame to the floorboard, wherein the support frame may have a first leg having an upper first leg portion and a lower first leg portion, wherein the lower first leg portion may be removably coupled to the first bracket; a second leg shorter than the first leg and having an upper second leg portion and a lower second leg portion, wherein the lower second leg portion may be removably coupled to the second bracket, wherein the front frame edge may be disposed between the first leg and the second leg; and a rail extending from the first leg to the second leg, wherein the rail may be disposed at a rail angle, relative to first frame side-edge or the second frame side-edge.

DETAILED DESCRIPTION

1. Introduction

Figure 1A:
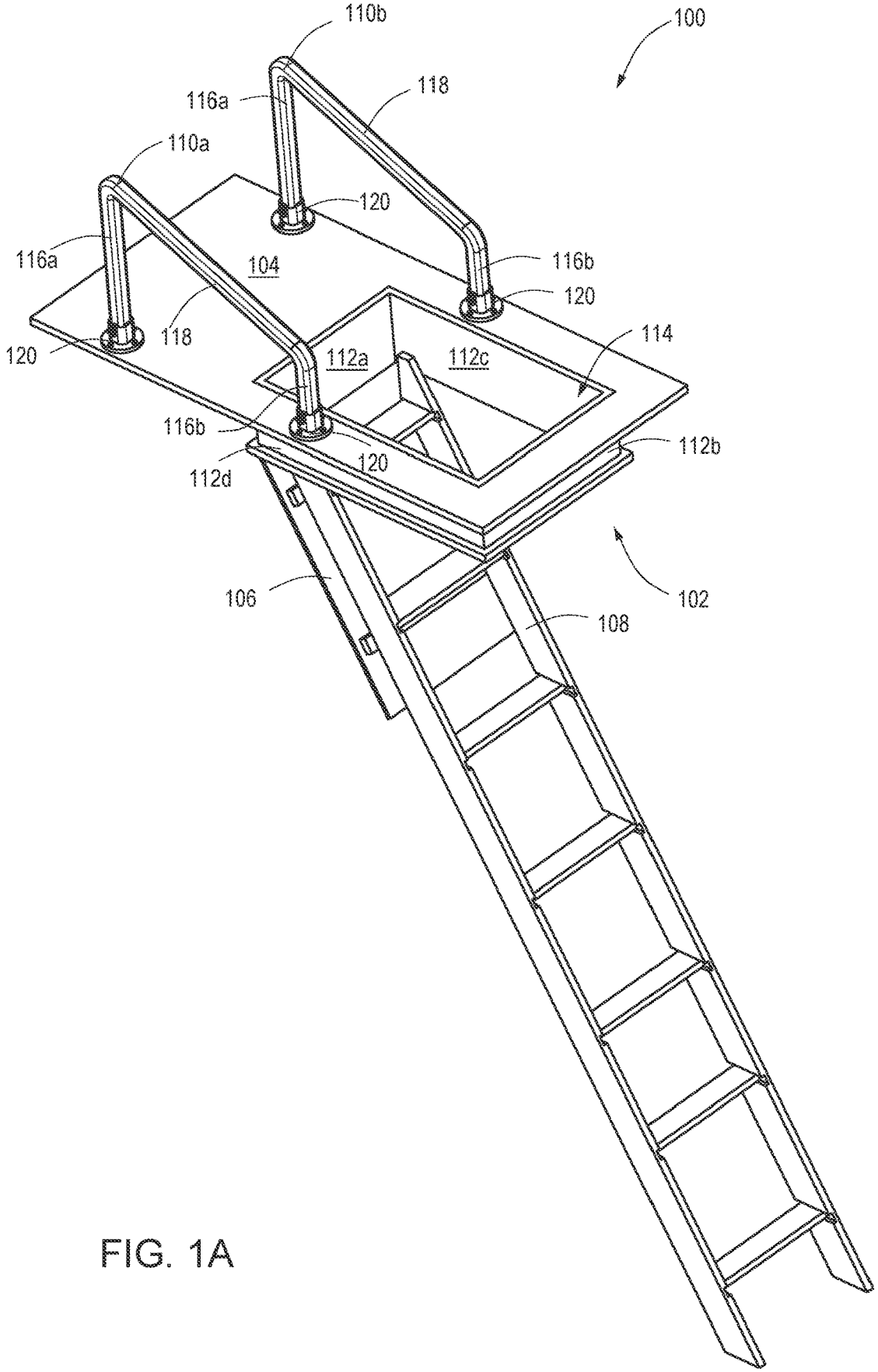
FIG. 1A illustrates a perspective view of an attic stair assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "acute angle" as used herein is defined as any angle that is less than 90 degrees. As depicted in some of the drawings herein, a support frame, e.g., a handrail, preferably includes at least one portion, e.g., an intermediate portion, that is linear in shape and has a central axis disposed at an acute angle relative to the upper surface of the floorboard, specifically to the upper surface of the floorboard that is closest to the intermediate portion. For example, in FIG. 1B, the axis of the rail 118 is at an acute angle relative to an axis along the upper surface of structure 104, where that axis on the supper surface is vertically below the axis of the rail 113.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." A first object may be abutted against a second object such that the second object is limited from moving in a direction of the first object. For example, a portion of an attic port door may be abutted against a port frame.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure or midpoint of a structure or surface in linear relation to another structure, surface, or midpoint of a structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid surface or object including a structure such as a ceiling, floorboard, port frame, support frame, and/or a bracket. For example, an aperture may be a three-dimensional opening that begins on one side of a solid object and ends on the other side of the object, e.g., an opening in an attic floor, a port frame, a support frame, or a bracket; or an aperture passing through an attic floor in which is disposed a port frame. An aperture that passes entirely through an attic floor may also be referred herein to as a "port." An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., port frame, support frame, or pin.

The term "assembly" as used herein is defined as any set of components that have been fully or partially assembled together. A group of assemblies may be coupled to form a larger assembly.

The term "congruent" as used herein as an adjective is defined as similar and/or superposable so as to be coincident by a majority of points and/or portions. A majority is any percentage greater than 50%.

The term "attic floor" as used herein is defined as the floor of an attic, which may be a room or space between the roof and a ceiling of a dwelling. An attic floor may be planar. An attic floor may have an upper surface that faces upward, upon which people can walk while in the attic, and a lower surface that faces downward, and where there is sometimes insulation material that separates the attic from the living quarters and other rooms of the house. An attic floor may have a port disposed therethrough, as described herein. More specifically, an attic floor may have a port extending through its upper surface and lower surface. An attic floor may have a floorboard disposed thereon. A portion of an attic may be a floorboard. An attic floor and a floorboard may be unitary.

The term "coupled" as used herein is defined as directly or indirectly connected or attached. A first object may be coupled to a second object such that the first object is positioned at a specific location and orientation with respect to the second object. For example, a motor may be coupled to a cutter assembly. A first object may be either permanently, removably, slidably, and/or pivotably coupled to a second object. Two objects are "permanently coupled," if once they are coupled, the two objects, in some cases, cannot be separated. Two objects may be "removably coupled" to each other via shear pins, threads, tape, latches, hooks, fasteners, locks, male and female connectors, clips, clamps, knots, and/or surface-to-surface contact. For example, a support frame and a bracket may be removably coupled to each other such that the support frame may then be uncoupled and removed from the bracket. Two objects may be "slidably coupled" where an inner aperture of one object is capable of receiving a second object. For example, foot of a support frame slid into a bracket may be slidably coupled to bracket. Additionally, two objects may be capable of being "pivotably coupled," e.g., where one object is capable of being rotated, swiveled, and/or pivoted relative to the other object. For example, a port door may be pivotably coupled to a port frame where the port door, in some cases, may be rotated relative to the port frame. Additionally, a stair may be pivotably coupled to a ceiling where the stair, in some cases, may be pivoted relative to the ceiling.

The term "dwelling" as used herein is defined any fully solid or partially solid structure that can receive people, animals, objects, and/or structures and has walls and space inside with room for some other structure, preferably multiple structures including stair assemblies, equipment, furniture, appliances, and/or other components. Examples of a dwelling may include a residence, a house, an apartment, a townhouse, or a condominium.

The term "exemplary" is used exclusively herein to mean "serving as an example, instance, or illustration." Anything, including any embodiment, structure, element, or step, described herein as exemplary, is not to be construed as preferred or advantageous over other embodiments, structures, elements, steps, etc.

The terms "first" and "second" as used herein merely differentiate two or more things or actions, and do not signify anything else, including order of importance, sequence, etc.

The term "floorboard" as used herein is defined as any fully solid or partially solid structure configured, sized, and/or shaped for a human to walk on or for setting an object or structure on.

The term "parallel" when referring to two lines or two planes, is defined to mean that the two lines are equidistant from each other or the two planes are equidistant from each other.

The term "pin" as used herein as a noun is defined as any fully solid or partially solid structure configured, sized, and/or shaped for inhibiting movement of a support frame. A pin may have a portion removably abutted against a support frame. A pin may have a portion abutted against a bracket.

The term "perpendicular" as used herein is defined as at an angle ranging from 85° or 88 to 92° or 95°. Two structures that are perpendicular to each other may be orthogonal and/or tangential to each other.

The term "providing" as used herein is defined as making available, furnishing, supplying, equipping, or causing to be placed in position.

The term "port door" as used herein is defined as any fully solid or partially solid structure that when disposed next to or within a port can be configured in various positions including an open position so that the port is open and a closed position so that the port is closed. A port door may by pivoted or swung open or closed in a door-like or gate-like fashion.

The term "stair" as used herein is defined as any structure that includes multiple steps, i.e., solid surfaces arranged in a step-wise configuration, and includes any fully solid or partially solid structure configured, sized, and/or shaped for a human to ascend or descend, e.g., by climbing, walking, crawling, or stepping. As used herein, the term "stair" is synonymous with "stairs," but for ease of usage herein the term "stair" is used most frequently. A stair may have a length and a width and may also have a depth, in which the length preferably has a distance greater than either the width or depth. A stair may include a portion that has a cross-section that is rectangular or some other geometric shape. A stair may have a proximal portion which is the portion closest to the ground, when the stair is in an unfolded configuration, and a distal portion which is the portion farthest from the ground when the stair is in an unfolded configuration. A stair may have one or more rungs. A stair may be folded, e.g., collapsed, onto an attic door.

The term "support frame" as used herein is defined as any fully solid or partially solid structure configured, sized, and/or shaped for a human to grasp or lean against. A support frame may have one or more legs and a rail coupled to the one or more legs, e.g., a rail extending between two legs, as illustrated in certain drawings herein. A support frame may be cylindrical, e.g., it may be tubular with a circular or oval cross-section. As used herein, at least one type of support frame is referred to as a "handrail" which may be a single unitary structure, or alternatively may include separate structures that are coupled together, at least one of the structures being shaped, configured, and positioned so when a human individual is climbing stairs to enter an attic, the human can easily grasp a portion of the handrail to support himself as he enters the attic through the port. In one or more specific embodiments disclosed herein, a handrail can include a forward portion that is coupled to the floorboard at a first position, a rear portion coupled to the floorboard at a second position, and an intermediate portion disposed between the forward and rear portions. The intermediate portion of the handrail preferably has either a curved shape with a concave lower side and a convex upper side; or a linear shape with a central axis disposed at an acute angle relative to the portion of the upper surface of the floorboard closest to the intermediate portion.

The term "surface" as used herein is defined as any face and/or boundary of a structure. A surface may also refer to that flat or substantially flat area that is extended across a flat structure which may, for example, be part of a plate and an arm. A surface may also refer to any curved area that extends circumferentially around a cylindrical structure or object which may, for example, be part of an arm and/or a rib. A surface may have irregular contours. A surface may be formed from coupled components, e.g., a port frame, a ceiling, a floorboard, a stair, a support frame, and/or a bracket. Coupled components may form irregular surfaces. A plurality of surfaces may be connected to form a polygonal cross-section. An example of a polygonal cross-section may be triangular, square, rectangular, pentagonal, hexagonal, or octagonal.

The term "unitary" as used herein defined as having the form of a single unit.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" or "top" identifies any object or part of a particular object that is farther away from the center of the earth than some other object or part of that particular object, when the objects are positioned in their intended useful positions. The term "lower" or "bottom" identifies any object or part of a particular object that is closer to the center of the earth than some other object or part of that particular object, when the objects are positioned in their intended useful positions.

The term "wall" as used herein is defined as any fully solid or partially solid structure having a planar surface. A wall may have two opposing sides. A wall may be a flat plate, e.g., disc. A wall may be cylindrical. A wall may be continuous. A wall may have curved planar sides that may or, in some cases, may not be parallel to one another. A wall may be rigid. A wall may be flexible. A wall may be planar. A wall may be curved. A wall may have one or more grooves. A wall may have one or more apertures disposed therethrough. A wall may have an aperture configured, sized, and/or shaped to receive a protrusion, e.g., pin or foot.

3. Certain Specific Embodiments

Disclosed herein are attic stair assemblies, in which each attic stair assembly may include: a frame that may include: a first wall; and a second wall; a stair coupled to the frame closer to the first wall than the second wall; a floorboard disposed above the stair; a port extending through the frame and the floorboard; and a support frame removably coupled to the floorboard that may include: a first leg having a first leg upper end, wherein the first leg may be closer to the first wall than the second wall; and a second leg having a second leg upper end, wherein the second leg may be shorter than the first leg and may be closer to the first wall than the second wall; and a rail portion extending from the first leg upper end to the second leg upper end at a first acute angle to the floorboard.

Additionally, disclosed herein are attic stair assemblies, in which each attic stair assembly may include: a floorboard having an upper surface that faces the inside of the attic, a stair that extends at an angle from a lower floor surface below the attic to the attic; a port extending through the floorboard, providing for entry to the attic via the stair and exit from the attic via the stair; and a support frame that may include: a forward portion coupled to the floorboard at a first position, a rear portion coupled to the floorboard at a second position, and an intermediate portion disposed between the forward and rear portions, the intermediate portion having either (a) a curved shape with a concave lower side and a convex upper side; or (b) a linear shape with a central axis disposed at an acute angle relative to the portion of the upper surface of the floorboard closest to the intermediate portion.

Also, disclosed herein are attic stair assemblies, in which each attic stair assembly may include: a frame that may have: a first wall; a second wall facing the first wall; a stair coupled to the frame, the stair extending at a first acute angle to the floorboard away from the first wall and towards the second wall; a floorboard disposed above the stair; a port extending through the frame and the floorboard; and a support frame removable coupled to the floorboard, wherein the support frame may have a curved portion having a tangent line extending at a second acute angle to the floorboard away from the first wall and away from the second wall.

In addition, disclosed herein are attic stair assemblies, in which each attic stair assembly may include: a frame that may have: a first wall having a first plane; and a second wall having a second plane; a stair coupled to the frame; a floorboard disposed above the stair; a port extending through the frame and the floorboard; and a support frame removably coupled to the floorboard that may include: a first leg having a first upper end; and a second having a second upper end, wherein the second leg may be shorter than the first leg and may be disposed between the first plane and the second plane; and a rail portion extending from the first upper end and the first wall towards the second upper end and the second wall.

Furthermore, disclosed herein are attic stair assemblies, in which each attic stair assembly may include: a frame that may include: a first frame side-edge; a second frame side-edge; a front frame edge extending from the first frame side-edge to the second frame side-edge; and a rear frame edge extending from the first frame side-edge to the second frame side-edge; a stair coupled to the front frame edge, wherein the stair may be capable of being pivoted to form a stair angle with the first frame side-edge or the second frame side-edge; a floorboard disposed above a lower edge of the frame; a first bracket coupled to the floorboard; a second bracket coupled to the floorboard; and a support frame that include: a first leg having an upper first leg portion and a lower first leg portion, wherein the lower first leg portion may be removably coupled to the first bracket; a second leg shorter than the first leg and having an upper second leg portion and a lower second leg portion, wherein the lower second leg portion may be removably coupled to the second bracket, wherein the front frame edge may be disposed between the first leg and the second leg; and a rail extending from the first leg to the second leg, wherein the rail may be disposed at a rail angle, relative to first frame side-edge or the second frame side-edge.

Disclosed herein are attic stair assemblies, in which each attic stair assembly may include: a frame that may have: a first wall; and a second wall facing the first wall; a stair coupled to the frame; a floorboard disposed above the stair; a port extending through the frame and the floorboard; and a support frame removable coupled to the floorboard, wherein the support frame may have a rail portion extending at a first acute angle to the floorboard away from the first wall and away from the second wall at a second acute angle.

Disclosed herein are methods of installing attic stair assemblies, in which each method may include: disposing a frame in an attic floor to define a port therethrough, where, the frame may have: a first wall; and a second wall facing the first wall; coupling a stair to the frame; disposing a floorboard above the stair; and coupling a support frame to the floorboard, wherein the support frame may have a rail portion extending at a first acute angle to the floorboard away from the first wall and away from the second wall at a second acute angle.

Disclosed herein are methods of installing attic stair assemblies, in which each method may include: disposing a floorboard inside the attic, where the floorboard may have an upper surface facing the inside of the attic, coupling a stair to the attic, wherein the stair may extend at an angle from a lower floor surface below the attic; disposing a port through the floorboard, providing for entry to the attic via the stair and exit from the attic via the stair; and disposing a support frame in the attic.

Disclosed herein are methods of installing attic stair assemblies, in which each method may include: disposing a frame in an attic floor to define a port therethrough, where, the frame may have: a first frame side-edge; a second frame side-edge; a front frame edge extending from the first frame side-edge to the second frame side-edge; and a rear frame edge extending from the first frame side-edge to the second frame side-edge; coupling a stair to the front frame edge, wherein the stair may be capable of being pivoted to form a stair angle with the first frame side-edge or the second frame side-edge; disposing a floorboard above a lower edge of the frame; coupling a first bracket to the floorboard; coupling a support frame to the floorboard, wherein the support frame may have a first leg having an upper first leg portion and a lower first leg portion, wherein the lower first leg portion may be removably coupled to the first bracket; a second leg shorter than the first leg and having an upper second leg portion and a lower second leg portion, wherein the lower second leg portion may be removably coupled to the second bracket, wherein the front frame edge may be disposed between the first leg and the second leg; and a rail extending from the first leg to the second leg, wherein the rail may be disposed at a rail angle, relative to first frame side-edge or the second frame side-edge.

In any one of the methods or assemblies disclosed herein, the support frame may include: a forward portion coupled to the floorboard at a first position, a rear portion coupled to the floorboard at a second position, and an intermediate portion disposed between the forward and rear portions, wherein the intermediate portion may have either (a) a curved shape with a concave lower side and a convex upper side; or (b) a linear shape with a central axis disposed at an acute angle relative to the portion of the upper surface of the floorboard closest to the intermediate portion.

In any one of the methods or assemblies disclosed herein, the support frame may have a curved portion having a tangent line extending at a second acute angle to the floorboard away from the first wall and away from the second wall.

In any one of the methods or assemblies disclosed herein, the support frame may have: a first leg having a first upper end; and a second having a second upper end, wherein the second leg may be shorter than the first leg and may be disposed between the first plane and the second plane; and a rail portion extending from the first upper end and the first wall towards the second upper end and the second wall.

In any one of the methods or assemblies disclosed herein, the support frame may have a curved portion having a tangent line extending at a second acute angle to the floorboard away from the first wall and away from the second wall.

In any one of the methods or assemblies disclosed herein, the first acute angle and the second acute angle may be congruent.

In any one of the methods or assemblies disclosed herein, the rail portion and the stair may be parallel In any one of the methods or assemblies disclosed herein, the tangent line and the stair may be parallel.

In any one of the methods or assemblies disclosed herein, the tangent line and the stair may be colinear.

In any one of the methods or assemblies disclosed herein, the rail may be parallel to the stair.

In any one of the methods or assemblies disclosed herein, the rail angle equals the stair angle.

In any one of the methods or assemblies disclosed herein, the rail may be capable of pivoting 90 degrees relative to the first bracket or second bracket.

In any one of the methods or assemblies disclosed herein, the rail may be capable of pivoting parallel to the floorboard.

In any one of the methods or assemblies disclosed herein, the rail extends in a downward direction from the first leg towards the floorboard.

In any one of the methods or assemblies disclosed herein, the rail extends in a downward direction from the upper first leg portion towards the upper second leg portion.

In any one of the methods or assemblies disclosed herein, the front frame edge may be perpendicular to a plane extending from the first leg to the second leg.

In any one of the methods or assemblies disclosed herein, the second bracket may be disposed adjacent the first frame side-edge or the second frame side-edge between the front frame edge and the rear frame edge.

In any one of the methods or assemblies disclosed herein, the lower second leg portion may be disposed adjacent the first frame side-edge or the second frame side-edge between the front frame edge and the rear frame edge.

Any one of the methods or assemblies disclosed herein may further include a first pin extends through the first bracket and the first leg.

Any one of the methods or assemblies disclosed herein may further include a second pin extends through the second bracket and the second leg.

4. Specific Embodiments in the Drawings

The drawings presented herein are for illustrative purposes only and do not limit the scope of the disclosure.

Rather, the drawings are intended to help enable one having ordinary skill in the art to make and use the assemblies disclosed herein.

This section addresses specific versions of attic stair assemblies shown in the drawings, which relate to assemblies, elements and parts that can be part of an attic stair assembly. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Figure 1B:
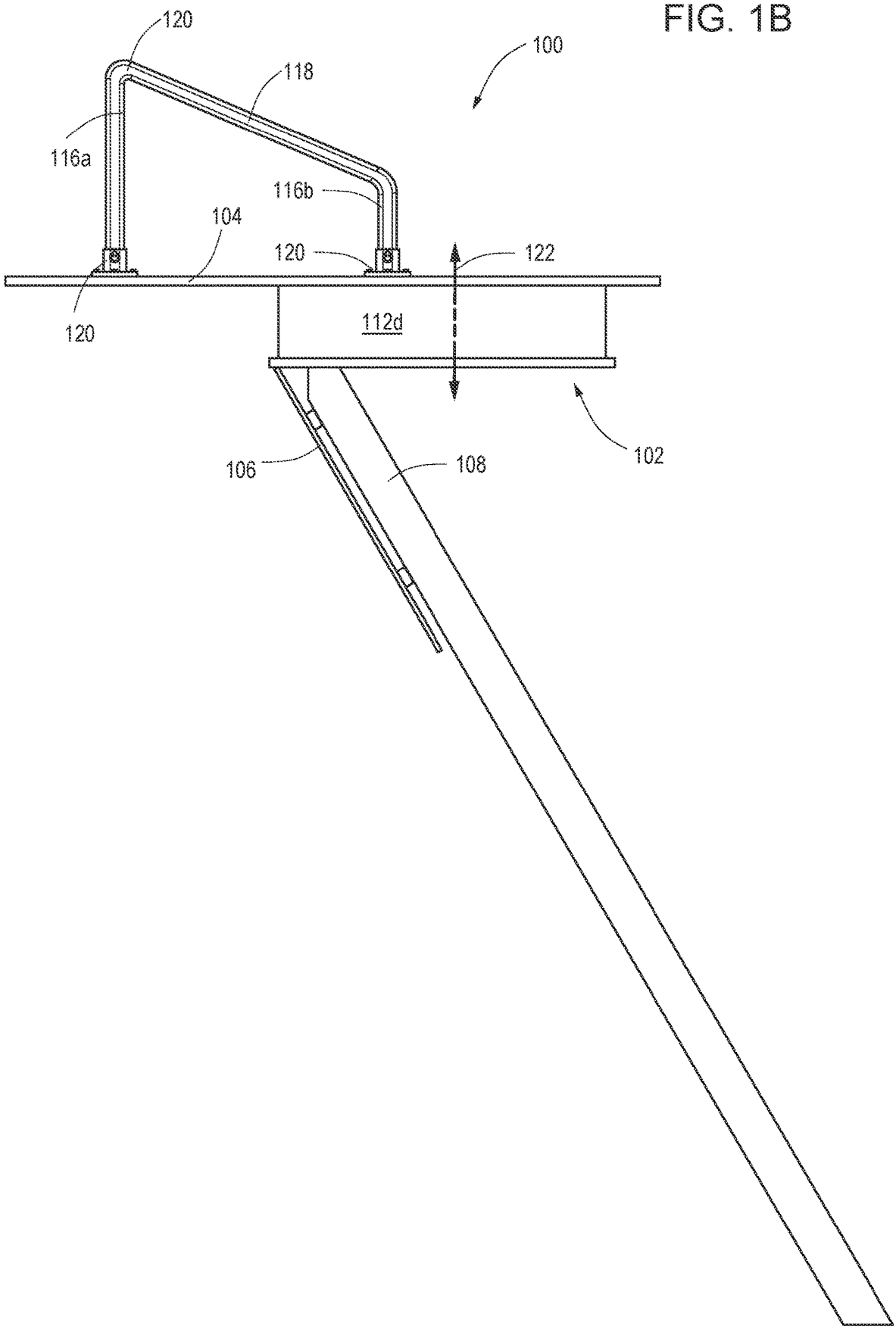
FIG. 1B illustrates a side view of an assembled attic stair assembly.
Figure 1C:
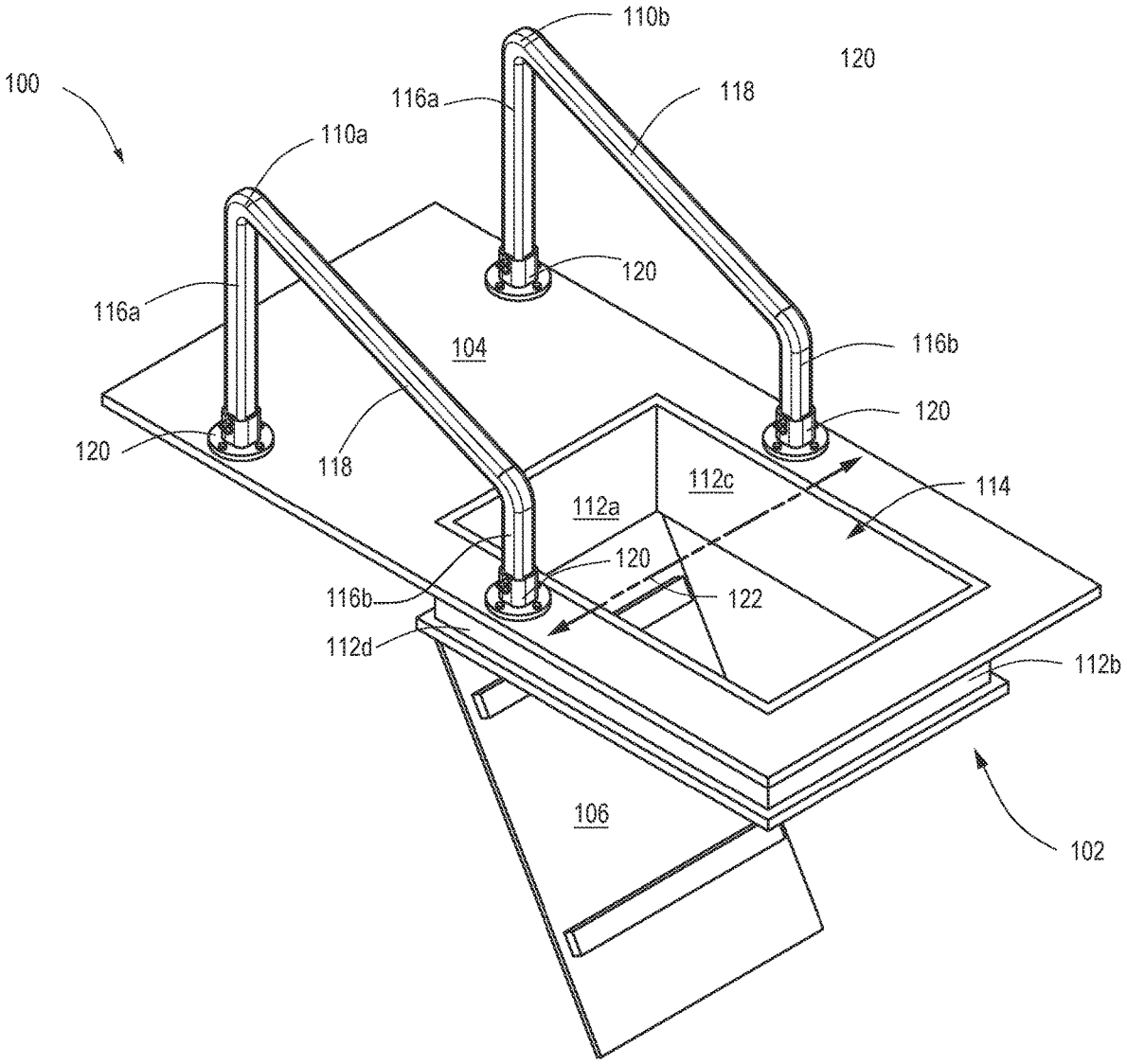
FIG. 1C illustrates a perspective view of a partially assembled attic stair assembly.

FIG. 1A illustrates a perspective view of an attic stair assembly 100. FIG. 1B illustrates a side view of an assembled attic stair assembly 100. FIG. 1C illustrates a close-up perspective view of a partially assembled attic stair assembly 100.

Referring to FIGS. 1A-C, an attic stair assembly 100 includes a port frame 102, a floorboard 104, a port door 106, a stair 108, and support frames 110*a*, 110*b*. The port frame 102 has four walls 112*a-d*. The four walls 112*a-d* are coupled at their ends, forming a rectangular cube. The port frame 102 is open on its top and its bottom so that a port 114 is defined by the four walls 112*a-d*. A person may pass, e.g., by climbing or stepping, through the port 114. The walls 112*a-d* extend from a lower surface of an attic floor (not shown) and to an upper surface of the attic floor. The port frame 102 is disposed in an opening, e.g., port, in the attic floor. Accordingly, the port 114 extends through the attic floor.

The floorboard 104 has an upper surface and a lower surface. The floorboard 104 has an opening, e.g., port, extending through the upper surface and the lower surface. The floorboard 104 is disposed around the port frame 102. The walls 112*a-d* of the port frame 102 also extend through the opening of the floorboard 104. The upper edges of the walls 112*a-d* and the upper surface of the floorboard 104 are co-planar.

The port door 106 is pivotably coupled to the inner surface of the wall 112*a*. The port door 106 has a planar upper surface and a planar lower surface. Hinges (not shown) are coupled to the upper surface of the door and the inner surface of the wall 112*a* of the port frame 102. Accordingly, the port door 106 is capable of being pivoted, e.g., via the hinges, between a closed position and/or an open position relative to the attic floor. In the closed position, the port door 106 may be parallel to the floorboard 108. As shown FIG. 1B, the port door 106 is pivoted to an open position to form an acute angle relative to a lower edge of the port frame 102 or the floorboard 108.

In some cases, the port door 106 may be pivotably coupled, e.g., via hinges, to the lower edge of the wall 112*a*. In other cases, the port door 106 may be pivotably coupled, e.g., via hinges, to the lower edge of the attic floor. The point at which the port door 106 pivots relative to the lower edge is closer to the first wall 112*a* than the second wall 112*b*.

The stair 108 is coupled to the upper surface of the port door 106. The point at which the stair 108 is coupled to the port door 106 is closer to the first wall 112*a* than the second wall 112*b*. The stair 108 may be constructed from three or more separate stair sections that are pivotably coupled so they can be folded, e.g., collapsed, against each other. The stair 108 may be folded for convenient stowing in the port 114 when the port door 106 is in the closed position. When the port door 106 is in an open position, the stair sections are unfolded and aligned to form a straight stair 108. Accordingly, the stair 108 and the port door 106 are parallel. The stair 108 and the lower edge of the port frame 102 form an acute angle, e.g., opposite the ground.

The stair 108 includes rungs, on which a person may step to climb up the stair 108 through the port 114 of the port frame 102.

Support frames 110*a*, 110*b* are coupled to the floorboard 104 so the person can grasp for assistance while climbing up the stair 108. Each support frame 110 has two legs 116*a*, 116*b* and a rail 118. Both legs 116*a*, 116*b* are closer to the wall 112*a* than the wall 112*b*. The two legs 116*a*, 116*b* have lowers ends removably coupled to brackets 120. The brackets 12*mdi*0 are removably coupled, e.g., via screws or bolts, to the floorboard 104. Pins 402 (see FIG. 4A) extending through the respective brackets 120 and legs 116*a*, 116*b* hold the legs 116*a*, 116*b* upright relative to the floorboard 104. Accordingly, the legs 116*a*, 116*b* are perpendicular to the floorboard 104.

The rail 118 extends from an upper end of the first leg 116*a* to an upper end of the second leg 116*b*. The first leg 116*a* is longer than the second leg 116*b*. Therefore, the rail 118 extends from the first leg 116*a* to the second leg 116*b* at an acute angle, e.g., opposite the floorboard 104. The rail 118 and unfolded stair 108 extend in similar directions, as shown in FIGS. 1A-C. Preferably, the rail 118 and the stair 108 are parallel to each other.

Referring to FIGS. 1A-C, the respective first legs 116*a* of the support frames 110*a*, 110*b* are coupled to the floorboard 104 a distance away from, e.g., in-front of, the wall 112*a* of the port frame 102. The respective second legs 116*b* of the support frames 110*a*, 110*b* are coupled to the floorboard 104 a distance away from, e.g., behind, the wall 112*a* of the port frame 102, between the walls 112*a*, 112*b*. In other words, the second legs 116*b* are disposed between respective planes of the walls 112*a*, 112*b*. Additionally, the second legs 116*b* are coupled to the floorboard 105 between the 112*a* and the midpoint 122 of the walls 112*c*, 112*d*. In other words, all legs 116*a*, 116*b* are closer to the wall 112*a* than the wall 112*b*.

Figure 2:
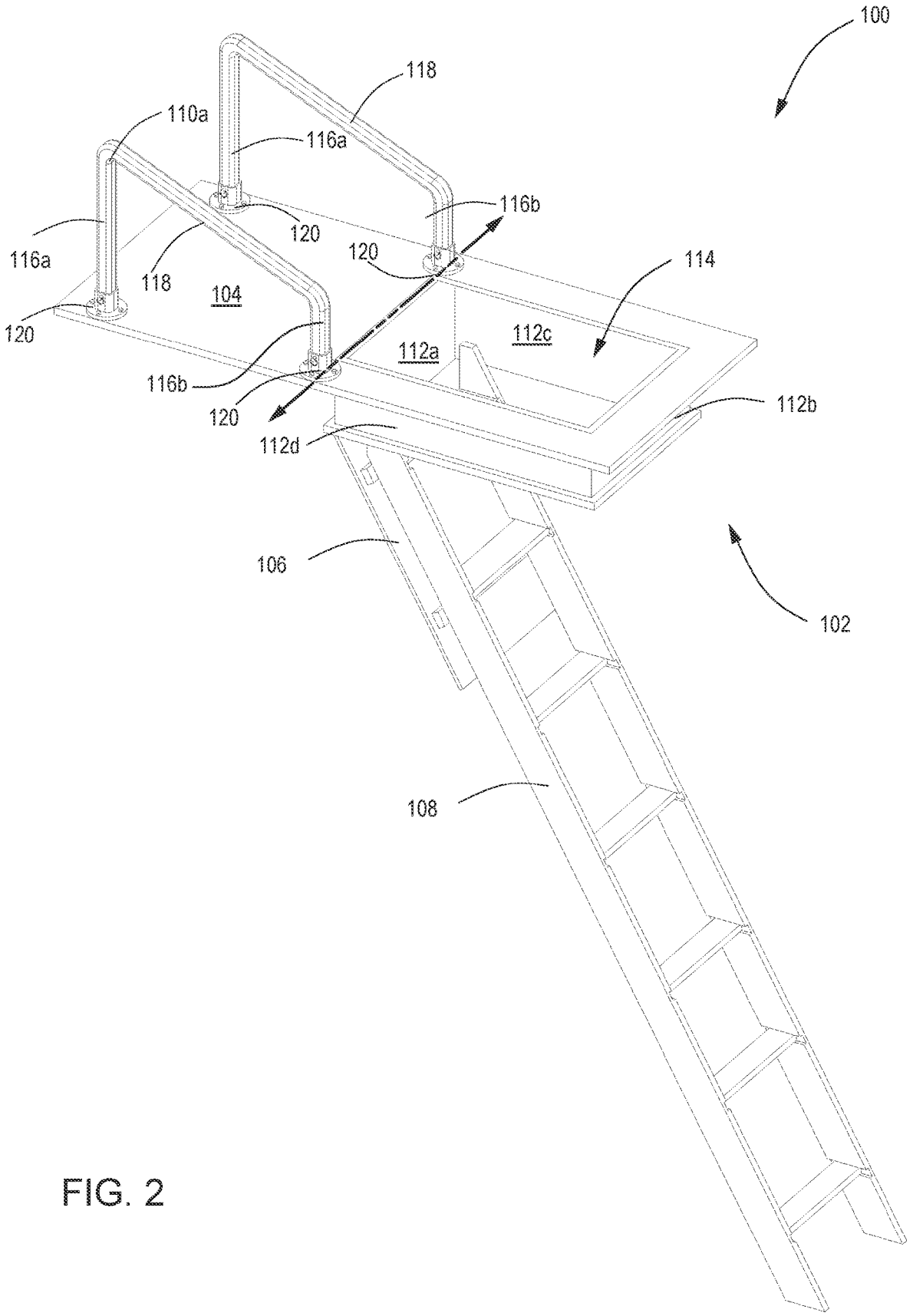
FIG. 2 illustrates a perspective view of an attic stair assembly having support frames disposed in front of the of the frame.

Referring to FIG. 2, respective first legs 116*a* of the support frames 110*a*, 110*b* are coupled to the floorboard 104 a distance away from, e.g., in-front of, the wall 112*a* of the port frame 102. Respective second legs 116*b* of support frames 110*a*, 110*b* are coupled to a floorboard 104 aligned with a wall 112*a* of a port frame 102. The second legs and the wall 112*a* are co-linear and/or have mid-points that are co-linear (as shown by the dash line).

Figure 3A:
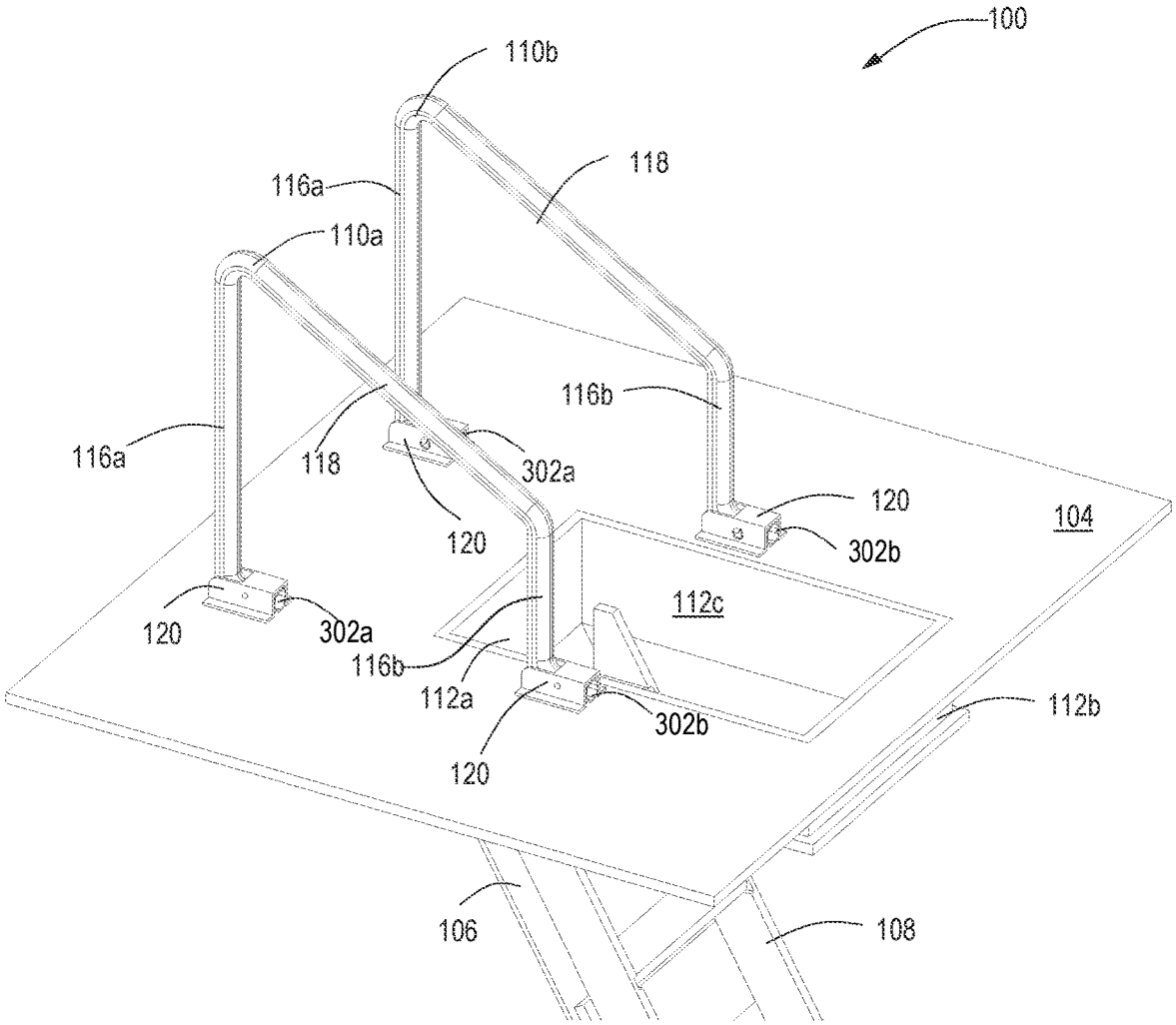
FIG. 3A illustrates a perspective view of an attic stair assembly having swivel support frames in upright positions.
Figure 3B:
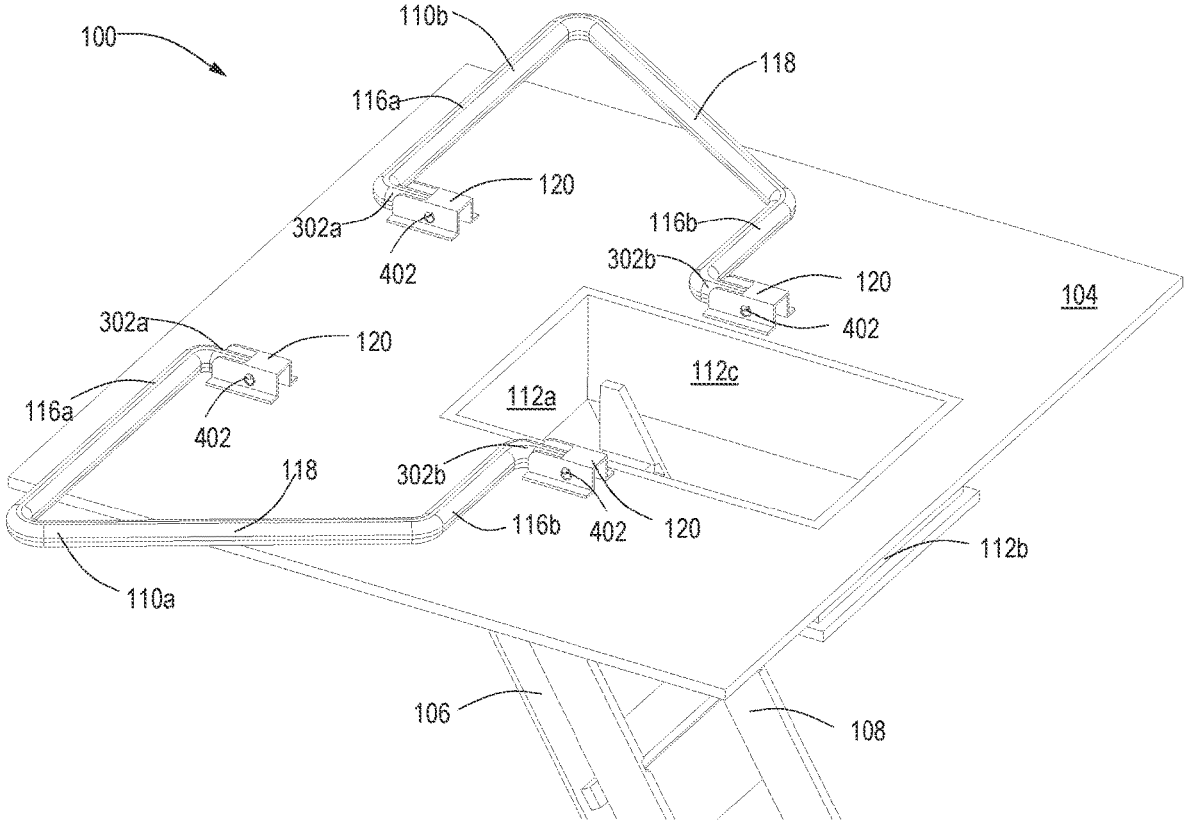
FIG. 3B illustrates a perspective view of an attic stair assembly having swivel support frames in folded positions.

FIG. 3A illustrates a perspective view of an attic stair assembly having swivel support frames 110*a*, 110*b* in upright positions. FIG. 3B illustrates a perspective view of an attic stair assembly having swivel support frames 110*a*, 110*b* in folded positions.

Referring to FIG. 3A-B, support frames 110*a*, 110*b* are coupled to a floorboard 104 so the person can grasp for assistance while climbing up an unfolded stair 108. Each support frame 110 has two legs 116*a*, 116*b* and a rail 118. The two legs 116*a*, 116*b* have respective feet 302*a*, 302*b* pivotably coupled to a bracket 120. The bracket 120 is removably coupled, e.g., via screws or bolts, to the floorboard 104. The rail 118 extends from an upper end of the first leg 116*a* to an upper end of the second leg 116*b*. The first leg 116*a* is longer than the second leg 116*b*. Therefore, the rail 118 extends from the first leg 116*a* to the second leg 116*b* at an acute angle, e.g., relative to the first leg 116*a*. The rail 118 and the unfolded stair 108 extend in similar directions, as shown in FIG. 3A. In other words, the angles at which the rail 118 and the stair 108 extend are both less than 90 degrees and may be unequal. However, preferably, the rail 118 and the stair 108 are parallel to each other.

In FIG. 3A, pins 302 extending through the respective brackets 120 and feet 302*a*, 302*b* of support frames 110*a*, 110*b* hold the respective legs 116*a*, 116*b* of the support frames 110*a*, 110*b* upright relative to the floorboard 104. Accordingly, the legs 116*a*, 116*b* of the respective support frames 110*a*, 110*b* are perpendicular to the floorboard 104.

In FIG. 3B, the pins 302 are removed from the respective brackets 120 and feet 302*a*, 302*b*. The legs 116*a*, 116*b* of the respective support frames 110*a*, 110*b* are slid away from their respective brackets 120. Additionally, the support frames 110*a*, 110*b* are pivoted away from each other against the floorboard 104. Accordingly, the legs 116*a*, 116*b* are parallel to the floorboard 104.

Figure 4A:
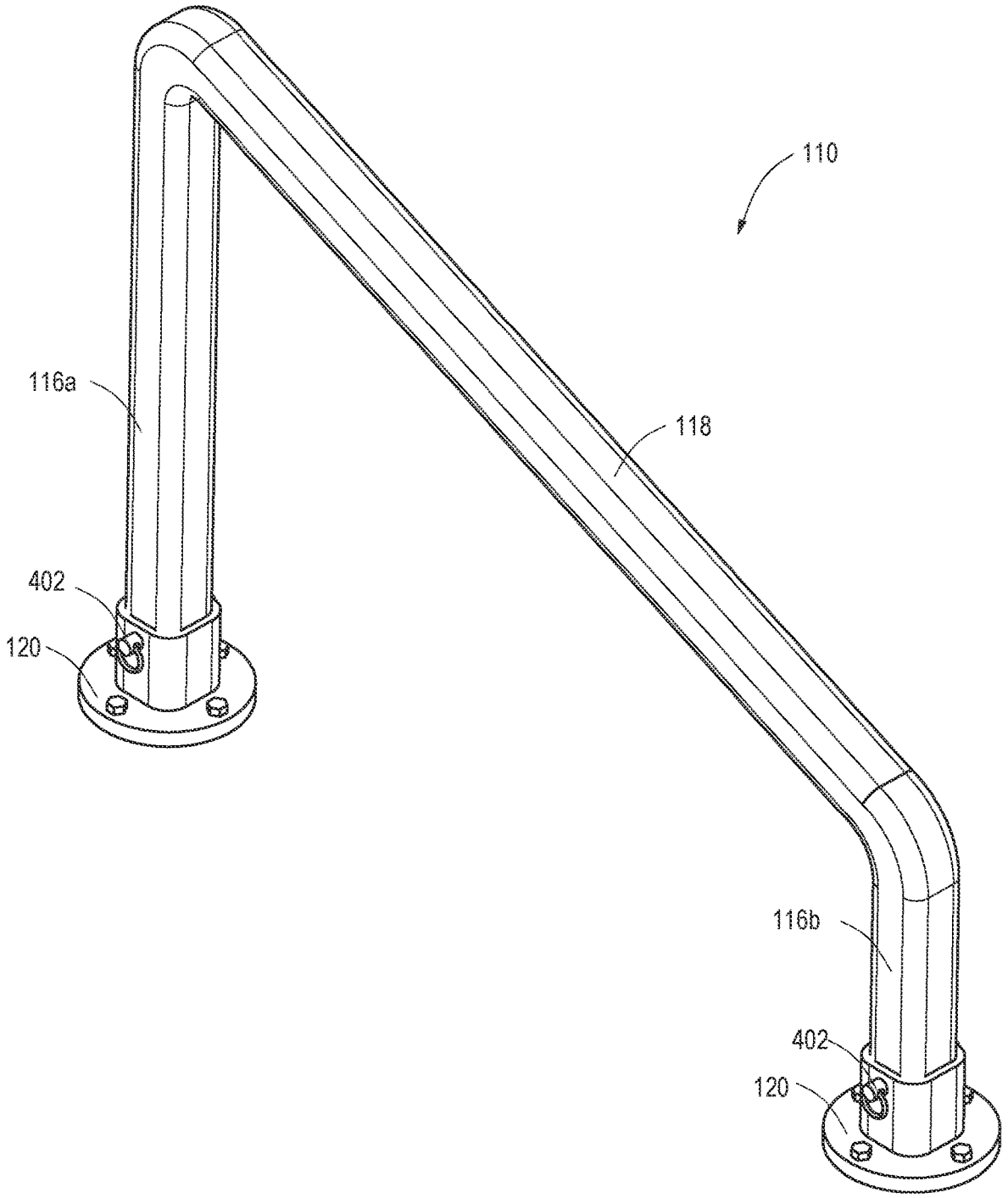
FIG. 4A illustrates a perspective view of a support frame having a quadrilateral profile.

FIG. 4A illustrates a perspective view of a support frame 110 having a quadrilateral profile. The support frame 110 has two legs 116*a*, 116*b* and a rail 118. The two legs 116*a*, 116*b* have lowers ends removably coupled to brackets 120. Pins 402 extend through the respective brackets 120 and legs 116*a*, 116*b* to hold the legs 116*a*, 116*b* to the brackets 120.

The rail 118 extends from an upper end of the first leg 116*a* to an upper end of the second leg 116*b*. The first leg 116*a* is longer than the second leg 116*b*. Therefore, the rail 118 extends from the first leg 116*a* to the second leg 116*b* at an acute angle, e.g., relative to the first leg 116*a*.

Figure 4B:
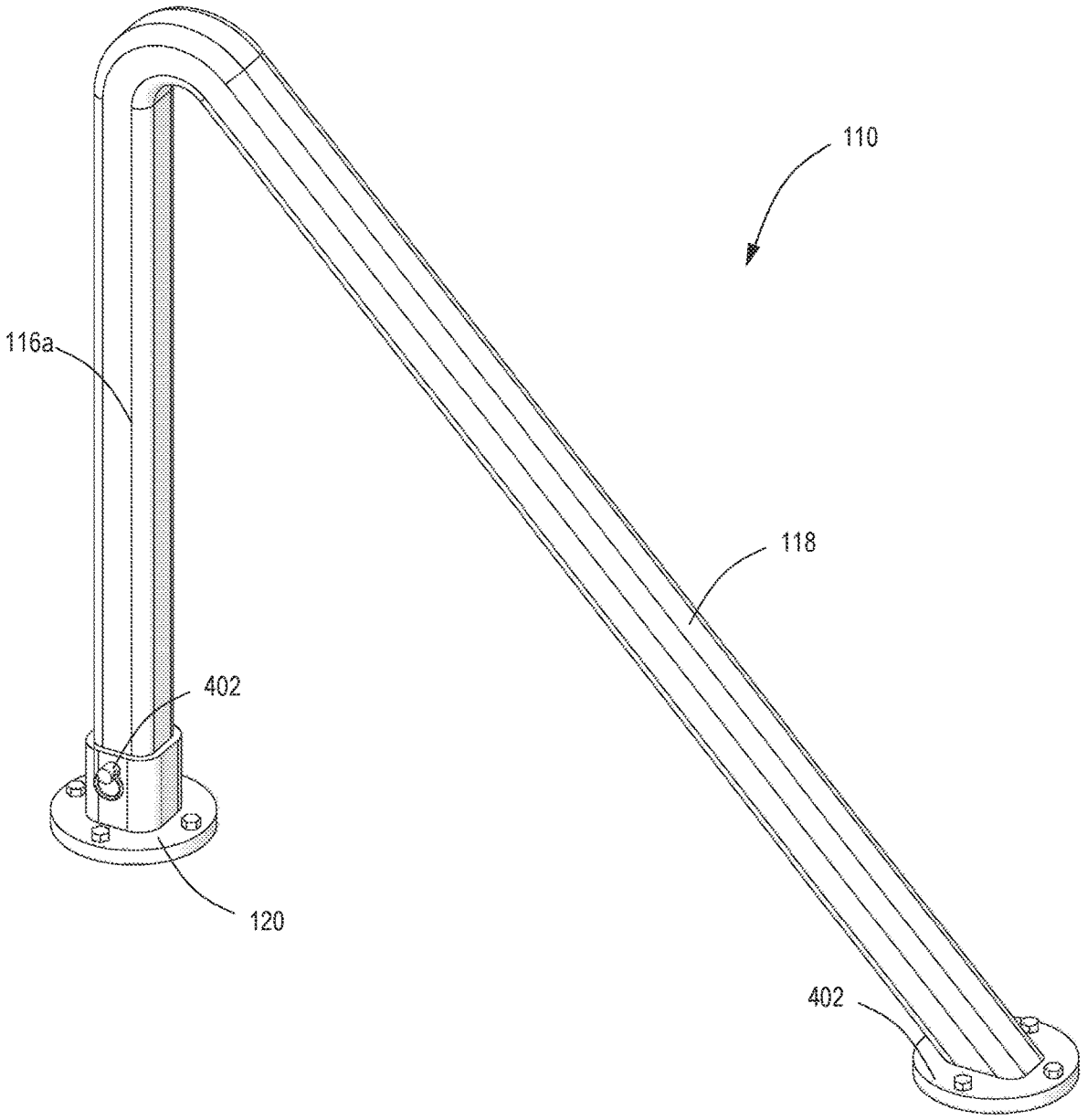
FIG. 4B illustrates a perspective view of a support frame having a triangular profile.

FIG. 4B illustrates a perspective view of a support frame having a triangular profile. The support frame 110 has a leg 116 and a rail 118. The leg 116 have a lower end removably coupled to a bracket 120. A pin 402 extend through the bracket 120 and the leg 116 to hold the leg 116 to the bracket 120.

The rail 118 extends from an upper end of the leg 116 at an acute angle. The rail 118 has a lower end coupled to a bracket 120.

Figure 5A:
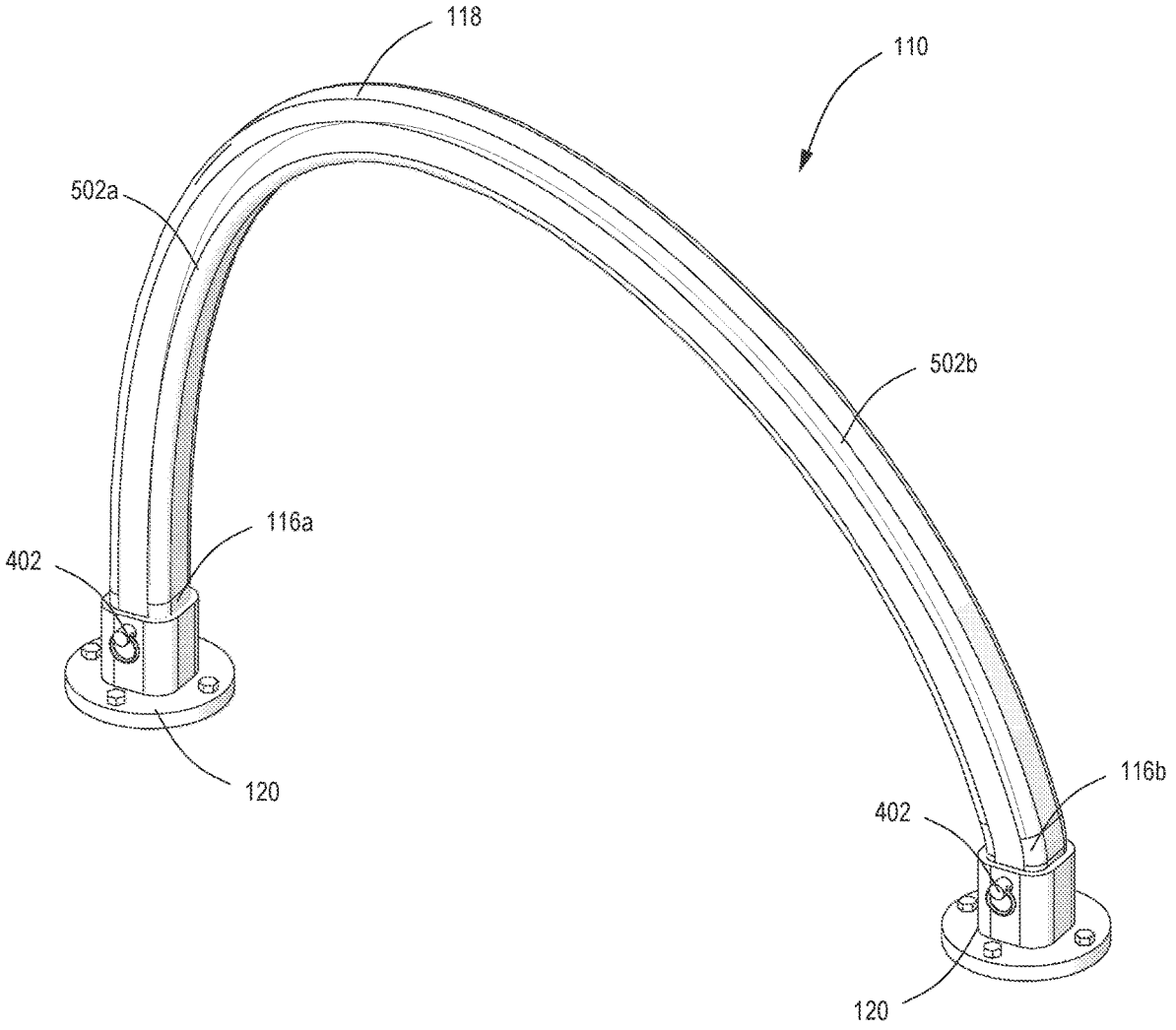
FIG. 5A illustrates a perspective view of a support frame having a curved profile.

FIG. 5A illustrates a perspective view of a support frame 110 having a curved profile. The support frame 110 has two legs 116*a*, 116*b* and a curved rail 118. The two legs 116*a*, 116*b* and the curved rail 118 may be unitary such that the two legs 116*a*, 116*b* and the rail 118 form one continuous curve. The two legs 116*a*, 116*b* have lower ends removably coupled to brackets 120. Pins 402 extend through the respective brackets 120 and legs 116*a*, 116*b* to hold the legs 116*a*, 116*b* to the brackets 120.

The curved rail 118 extends from an upper end of the first leg 116*a* to an upper end of the second leg 116*b*.

Figure 5B:
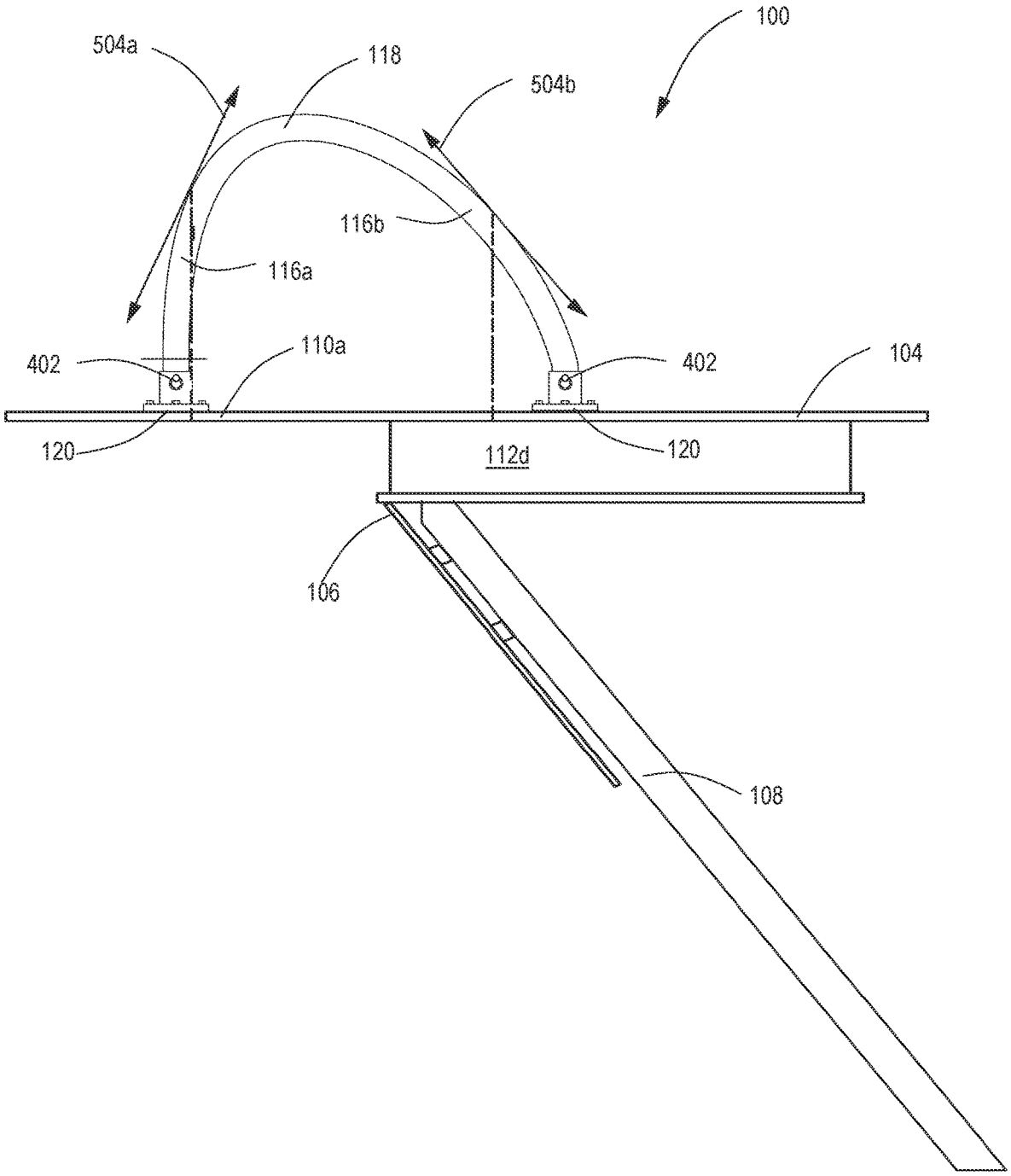
FIG. 5B a perspective view of an attic stair assembly including a curved support frame.

Referring to FIG. 5B, the curved rail 118 has first curve portion 502*a* and second curve portion 502*b*. The first curve portion 502*a* is shorter than the second curve portion 402*b*. Additionally, the first curve portion 502*a* has a first tangent line 504*a* extending at a first angle relative to a floorboard 104. The second curve portion 502*b* has a second tangent line 504*b* extending at a second angle relative to the floorboard 104. The first angle is greater than the second angle. The second tangent line 504*b* and the unfolded stair 108 extend in similar directions. In other words, the angles at which the tangent line 504*b* and the stair 108 extend are both less than 90 degrees and may be unequal. However, preferably, the second tangent line 504*b* and the stair 108 are parallel to each other.

An operator may perform the following steps to safely climb into an attic through a ceiling of a dwelling with an attic stair assembly 100, assuming a port door 106 is closed and a stair 108 is folded and stowed in the attic. Referring to the views of FIGS. 1-3, the operator may pull, e.g., via a pull string (not shown), the port door 106 to open a port 114 in the ceiling into the attic. Next, the operator may unfold the stair 108. The stair 108 may extend from the ceiling to the ground at an acute angle. The stair 108 may extend in a similar direction towards a rail 118 of a support frame 110. Alternatively, the stair 108 may extend in a similar direction towards a tangent line 504 of curve portion of the rail 118. Preferably, the stair 108 and the rail 118 and/or the tangent line are parallel.

Afterwards, the operator may step on rungs of the stair 108 to climb the stair 108 up towards the port 114. At the port 114, while holding onto a portion of the stair 108 with one hand, the operator may extend an arm overhead through the port 114. The operator may grasp a leg 116*b* of the support frame 110. Risks of injury, e.g., falling, tripping, and/or slipping, may be reduced because the operator now has a stable structure to hold onto while climbing through the port 114.

As the operator continues to climb up the stair 108 and through the port 114, the operator may continue sliding his/her hand along the rail 118 in an upward path. Because the rail 118 rises from the leg 116*b*, e.g., at an angle similar to or parallel the stairs 108, the operator may maintain an upright posture while holding onto the rail 118 and moving up and forward through the port 114. Thus, the operator may safely and conveniently enter the attic through the port 114 while holding onto the rail 118 as a guide (even if the attic space were initially dark).

The operator may exit the attic by performing the steps discussed above in reverse.

Additionally, referring to FIGS. 5A-B, in case of carrying one or more large objects into the attic, the operator may fold the upright support frame 110 for better clearance to move the object in the attic. First, the operator may remove pins from 402 to unlock the support frame 110 from respective brackets 120. Next, the operator may push the feet 302*a*, 302*b* of the support frame 110 away from respective brackets 120. Then, the operator may pivot the support frame 110 to fold flat, e.g., perpendicular to the original upright position of the support frame 110.

The operator may perform the above discussed steps in reverse to descend from the attic on the stair 108 using the support frame 104 for assistance.

What is claimed as the invention is:

1. An attic stair assembly, comprising:

a frame that comprises:

a first side wall;

a second side wall;

a front wall; and a rear wall;

a stair coupled to the frame closer to the front wall than to the rear wall;

a floorboard disposed above the stair;

a port extending through the frame and the floorboard; and a handrail removably coupled to the floorboard, comprising:

a first leg having a first leg upper end, wherein the first leg is closer to the front wall than to the rear wall and is disposed in front of the front wall; and a second leg having a second leg upper end, wherein the second leg is shorter than the first leg and is disposed behind the front wall and in front of the rear wall; and a rail portion extending from the first leg upper end to the second leg upper end at a first acute angle to the floorboard.

2. The attic stair assembly of claim 1, wherein the rail portion and the stair are parallel.

3. The attic stair assembly of claim 1, wherein the rail extends in a downward direction from the first leg upper end towards the floorboard.

4. The attic stair assembly of claim 1, wherein the rail extends in a downward direction from the first leg upper end towards the second leg upper end.

5. The attic stair assembly of claim 1, wherein the second leg is disposed between a first plane of the front wall and a second plane of the second wall.

6. The attic stair assembly of claim 1, wherein the front wall extends from the first side wall to the second side wall.

7. The attic stair assembly of claim 1, wherein the rear wall extends from the first side wall to the second side wall.

8. The attic stair assembly of claim 1, wherein the rail is parallel to the stair.

9. The attic stair assembly of claim 1, wherein the first acute angle is equal to a second acute angel formed by the stair angle and floorboard.

10. An attic stair assembly, comprising:

a frame that comprises:

a first frame side-edge;

a second frame side-edge parallel to the first frame side-edge;

a front frame edge extending from the first frame side-edge to the second frame side-edge; and a rear frame edge extending from the first frame side-edge to the second frame side-edge;

a stair coupled to the front frame edge, wherein the stair is capable of being pivoted to form a stair angle with the first frame side-edge or the second frame side-edge;

a floorboard disposed above a lower edge of the frame;

a first bracket coupled to the floorboard;

a second bracket coupled to the floorboard; and a handrail that comprises:

a first leg disposed in front of the front frame edge and having an upper first leg portion and a lower first leg portion, wherein the lower first leg portion is removably coupled to the first bracket;

a second leg, shorter than the first leg, disposed behind the front frame edge and in front of the rear frame edge and having an upper second leg portion and a lower second leg portion, wherein the lower second leg portion is removably coupled to the second bracket, wherein the front frame edge is disposed between the first leg and the second leg; and a rail extending from the first leg to the second leg, wherein the rail is disposed at a rail angle, relative to the floorboard.

11. The attic stair assembly of claim 10, wherein the rail is parallel to the stair.

12. The attic stair assembly of claim 10, wherein the rail angle equals the stair angle.

13. The attic stair assembly of claim 10, wherein the rail extends in a downward direction from the first leg towards the floorboard.

14. The attic stair assembly of claim 10, wherein the rail extends in a downward direction from the upper first leg portion towards the upper second leg portion.

15. The attic stair assembly of claim 10, wherein the front frame edge is perpendicular to a plane extending from the first leg to the second leg.

16. The attic stair assembly of claim 10, wherein the second bracket is disposed adjacent the first frame side-edge or the second frame side-edge between the front frame edge and the rear frame edge.

17. The attic stair assembly of claim 10, wherein the lower second leg portion is disposed adjacent the first frame side-edge or the second frame side-edge between the front frame edge and the rear frame edge.

18. The attic stair assembly of claim 10, further comprising a first pin extends through the first bracket and the first leg.

19. The attic stair assembly of claim 10, further comprising a second pin extends through the second bracket and the second leg.

* * * * *